United States Patent [19]

Chambers

[11] Patent Number: 4,934,055

[45] Date of Patent: Jun. 19, 1990

[54] AEROSOL CAN OPENER

[75] Inventor: Philip A. Chambers, Lompoc, Calif.

[73] Assignee: Keith DeMott, Cocoa Beach, Fla. ; a part interest

[21] Appl. No.: 204,714

[22] Filed: Jun. 10, 1988

[51] Int. Cl.[5] ..... B26F 1/00

[52] U.S. Cl. ..... 30/366; 220/3; 220/281; 141/330; 222/80

[58] Field of Search ..... 30/366, 305, 315; 220/3, 277, 278, 284; 222/80; 141/330

[56] References Cited

U.S. PATENT DOCUMENTS

| | | | |
|---|---|---|---|
| 732,203 | 6/1903 | Lowry | 141/330 X |
| 2,528,530 | 11/1950 | Machleder | 141/330 X |
| 3,349,821 | 10/1967 | Moellen | 30/366 |
| 3,797,112 | 3/1974 | Paulson | 30/366 |
| 3,834,589 | 9/1974 | Morane et al. | 222/80 |
| 4,706,849 | 11/1987 | Ryan | 222/80 |
| 4,768,568 | 9/1988 | Fournier et al. | 141/330 |

FOREIGN PATENT DOCUMENTS

| | | | |
|---|---|---|---|
| 265642 | 7/1964 | Netherlands | 222/80 |

*Primary Examiner*—Frank T. Yost
*Assistant Examiner*—Willmon Fridie, Jr.
*Attorney, Agent, or Firm*—Daniel C. McKown

[57] ABSTRACT

A device for use in rendering a discarded pressurized can partly filled with a hazardous liquid disposable as non-hazardous waste that can be buried, by depressurizing the discarded pressurized can and collecting the hazardous liquid in a single safe reservoir includes a reservoir that has a top to which is affixed an upwardly extending hollow open-ended cylinder into which the pressurized can is inserted in an upright position. At the bottom of the hollow cylinder is a piercer for producing a hole in the bottom of the can. An inverted cylindrical cup is placed over the pressurized can and is forced downwardly against the top of the can, thereby creating a pressure in the can so that when the bottom of the can is pierced by the piercer, the hazardous liquid within the can will be expelled by the pressure and will flow into the reservoir.

4 Claims, 1 Drawing Sheet

AEROSOL CAN OPENER

BACKGROUND OF THE INVENTION

1. Field of the Invention

The present invention is in the field of waste disposal and specifically relates to a device for facilitating the disposal of discarded pressurized canisters that typically contain hazardous liquid wastes.

2. The Prior Art

Some years ago it was customary to dispose of discarded partly-full pressurized cans by simply treating them as solid non-hazardous waste materials and burying them.

Over the intervening years it has become recognized that when these pressurized cans deteriorate they release their hazardous liquids into the ground, thereby contaminating the ground water and creating potential health hazards.

Still more recently, regulations of the Environmental Protection Agency and of corresponding state agencies require that partially filled pressurized cans must be disposed of in the manner required for liquid hazardous wastes; i.e., by burning or by being stored in specially constructed containers. The regulations are emphatic that liquid hazard waste can no longer be buried.

Unfortunately, the burning or long-term storage required for liquid wastes is much more expensive than the burial required for solid hazardous waste. The present inventor recognized that if the pressurized cans could be emptied of their liquid hazardous wastes, the empty cans could be disposed of in the manner required for solid hazardous waste, at a considerable cost saving.

SUMMARY OF THE INVENTION

The present inventor has made a two-fold contribution. First, he recognized the existence of a problem; namely, that it is very expensive to dispose of discarded pressurized containers because they must be dealt with as liquid hazardous wastes. Second, the present inventor found a way to overcome this problem; namely, by removing the liquid hazardous wastes from the cans before disposing of the cans.

In accordance with the present invention, a collection of discarded pressurized cans is brought to a station at which the present invention is located. The cans are then processed one at a time. The processed empty cans are then thrown into a container intended for ordinary trash, and the liquid which remained in the cans is accumulated in a single large container of the type used for safe handling of liquid hazardous wastes.

In accordance with the present invention, each can to be processed is held in an upright attitude, and a hole is then produced in the bottom of the can so that the pressure produced when the can is partially collapsed by the device of the present invention blows the hazardous liquid out through the hole produced in the bottom of the can and into a larger container that serves as a reservoir for the liquid hazardous wastes.

In accordance with a preferred embodiment of the present invention, there is provided a cylindrical container that serves as a reservoir. A hollow cylinder extends upwardly from the top of the reservoir container, and the can is inserted into this sleeve. At the bottom end of the sleeve, a piercer is attached to the top, and there is a hole through the top located adjacent the piercer inside the sleeve. After the can has been inserted into the sleeve in an upright position, a hollow cylindrical cup-like protective outer sleeve is slipped over the can and the entire sleeve. This outer sleeve prevents the liquid contents of the can from spraying in the direction of the user. The user applies a downward force to the cup-like outer sleeve to force the can against the piercer, which then produces a hole in the bottom of the can. Further application of the downward force opens the can further, and residual propellant pressure, assisted by gravity, blows the remaining hazardous liquid from the can. The ejected liquid is confined by the inner sleeve assuring immediate flow through the top of the reservoir and accumulation in the reservoir.

The novel features which are believed to be characteristic of the invention, both as to organization and method of operation, together with further objects and advantages thereof, will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DETAILED DESCRIPTION OF THE PREFERRED EMBODIMENT

Figure 1:
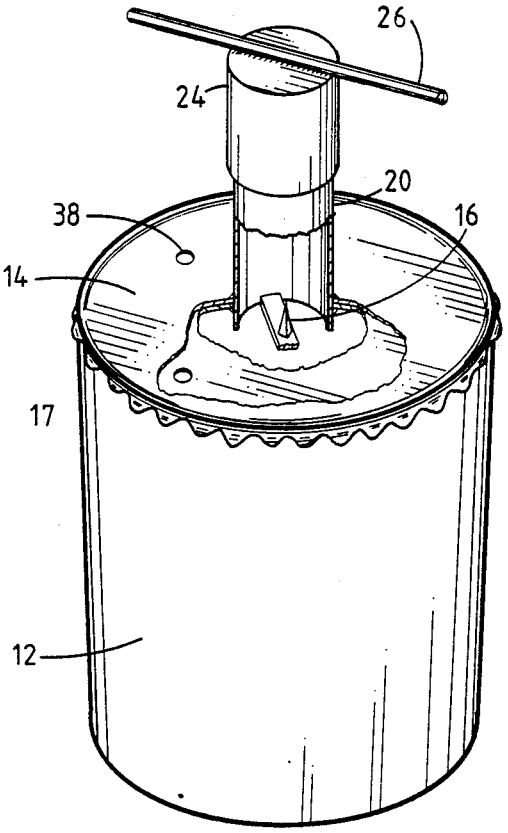
FIG. 1 is a perspective view showing the front and top of the preferred embodiment of the invention; and, FIG. 2 is a fractional cross-sectional front elevational view of the upper portion of the preferred embodiment of FIG. 1 taken in the plane 2-2 indicated in FIG. 1.
Figure 2:
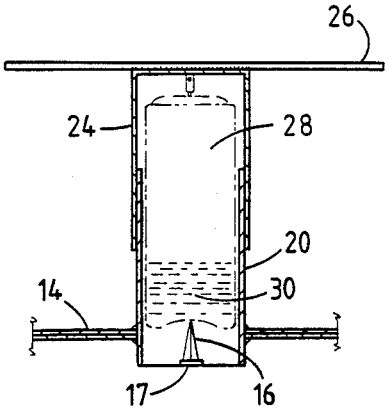

FIGS. 1 and 2 are different views of the same preferred embodiment of the invention. In the preferred embodiment, the reservoir 12 is a DOT 17C 5-gallon container. The reservoir 12 is closed at its upper end by the top 14.

In the preferred embodiment, the top 14 is formed by welding together two container lids at cylinder 20. Each of the two lids has a set of vent holes, of which the vent hole 38 is typical, and the vent holes of one lid are purposely not in registration with the vent holes of the other lid. This permits the release of pressure from the reservoir, but prevents the contents of the reservoir from splashing out. The double-lid construction of the preferred embodiment also makes the top 14 more rigid.

In the preferred embodiment, a piercer 16 is welded to a steel bar 17, which is then welded to the cylinder 20 so as to extend diametrically across the lower end of the cylinder 20. In the preferred embodiment, the piercer 16 has the shape of a pyramid whose apex is directed upwardly.

The cylinder 20 is then inserted through a central circular opening in the top 14 and the cylinder 20 is then welded at its girth to the top 14 in this position, as shown in FIG. 2. Except for the bar 17, the remainder of the bottom end of the cylinder 20 is open, as best seen in FIG. 1. The open space permits liquid discharged from the aerosol cans to drain directly into the reservoir 12.

The height of the hollow cylinder 20 must be appreciably less than the height of the discarded pressurized can 28, and in the preferred embodiment, the height of the hollow cylinder 20 is approximately three-fourths of the height of the discarded pressurized can 28.

An inverted cylindrical cup 24 fits loosely over the hollow cylinder 20 and serves as a convenient way of applying a downward force to the discarded pressurized can 28. Because the cylindrical walls of the cylindrical cup 24 extend below the top of the hollow cylinder 20, it is impossible for liquids ejected from the discarded pressurized can 28 to spray upward onto the face or body of the user. In the preferred embodiment, a handle 26 is welded to the outside of the closed end of the cylindrical cup 24 to permit the user to grasp both ends of the handle with his hands to provide the downward force on the cylindrical cup 24.

In operation, the cylindrical cup 24 is removed from the device and the discarded pressurized can 28 is inserted into the hollow cylinder 20 of FIG. 2 in an upright position, so that the hazardous liquid 30 will occupy the lower portion of the can. It is well known that discarded pressurized cans often retain some internal pressure.

Next, the cylindrical cup 24 is replaced, so that the closed end of the cup 24 rests on the top part of the can 28. At this point, the user grasps the ends of the handle 26 with his hands and pushes downward. This partially collapses the can momentarily increasing the pressure within the can beyond whatever residual pressure there might be in the can. The piercer 16 pierces the bottom of the can, thereby permitting the pressure in the can to expel the liquid 30 through the hole made by the piercer 16. The expelled liquid then drains through the generally open bottom end of the cylinder 20 into the reservoir 12. Thereafter, the user pulls upwardly on the handle 26 to remove the cylindrical cup 24, and the can 28 is manually removed from the hollow cylinder 20.

A major advantage of the device is that the processed can 28 is now considered to be non-hazardous waste instead of liquid hazardous waste and therefore the can 28 can be buried rather than having to be disposed of by costly long-term above-ground storage. The liquid can be burned or stored in cheaper large bulk containers.

The foregoing detailed description is illustrative of one embodiment of the invention, and it is to be understood that additional embodiments thereof will be obvious to those skilled in the art. The embodiments described herein together with those additional embodiments are considered to be within the scope of the invention.

What is claimed is:

1. An article for use in rendering a discarded pressurized can partly filled with a hazardous liquid disposable as solid ordinary trash, by depressurizing the discarded pressurized can and collecting the hazardous liquid in a single safe reservoir, said article comprising:

a reservoir including a top;

a hollow cylinder, open ended, affixed to the top of the reservoir with its axis vertical, having an upper end and a lower end, the bore of said hollow cylinder slightly larger than the diameter of the pressurized can to permit the pressurized can to be easily inserted and removed through the upper end of said hollow cylinder, the height of said hollow cylinder being less than the height of the pressurized can;

a piercer attached to the lower end of said hollow cylinder for piercing the pressurized can; and, an inverted cylindrical cup having a bore slightly larger than the outside diameter of said hollow cylinder to permit said inverted cylindrical cup to loosely slide axially along said hollow cylinder, the height of said inverted cylindrical cup being less than the height of the pressurized can, whereby after the pressurized can has been inserted bottom first into said hollow cylinder and thereafter said inverted cylindrical cup has been placed over the upper end of said hollow cylinder, a downward force applied to said inverted cylindrical cup will be transmitted to the top of the pressurized can, driving said piercer through the bottom of the pressurized can, thereby permitting the hazardous liquid in the can to be ejected through the resulting hole in the pressurized can, through the open bottom end of said hollow cylinder and into said reservoir.

2. The article of claim 1 wherein the lower end of said hollow cylinder extends below the top and into the reservoir.

3. The article of claim 1 further comprising a handle affixed to said inverted cylindrical cup on its closed end to facilitate the application of downward force.

4. The article of claim 1 wherein said piercer has the shape of a pyramid attached at its base to the lower end of said hollow cylinder with its apex pointing upwardly.

* * * * *